United States Patent [19]

Harrington

[11] Patent Number: 5,076,307

[45] Date of Patent: Dec. 31, 1991

[54] APPARATUS FOR SPRAYING A LIQUID IN A TANK

[76] Inventor: Max G. Harrington, 6022 Sundale Way #63, Fair Oaks, Calif. 95628

[21] Appl. No.: 473,037

[22] Filed: Jan. 31, 1990

[51] Int. Cl.[5] ..... B08B 3/02; B08B 9/08

[52] U.S. Cl. ..... 134/166 R

[58] Field of Search ..... 134/166 R, 167 R, 168 R, 134/169 R; 15/316.1; 4/492, 542

[56] References Cited

U.S. PATENT DOCUMENTS

| | | | |
|---|---|---|---|
| 1,693,885 | 12/1928 | Butterworth . | |
| 2,302,299 | 11/1942 | Court . | |
| 3,169,707 | 2/1965 | Williams | 134/167 RX |
| 3,444,869 | 5/1969 | Guignon et al. | 134/167 R |
| 4,261,075 | 4/1981 | Gruen | 15/316.1 |
| 4,262,371 | 4/1981 | Berry et al. | 4/492 X |
| 4,629,121 | 12/1986 | Hengesbach | 239/119 |

FOREIGN PATENT DOCUMENTS

| | | | |
|---|---|---|---|
| 2634481 | 2/1978 | Fed. Rep. of Germany | 134/167 R |

*Primary Examiner*—Philip R. Coe
*Attorney, Agent, or Firm*—Marjama & Pincelli

[57] ABSTRACT

An apparatus for directing a liquid spray against the interior walls of a vessel. The apparatus includes a housing mounted to the vessel. The housing has a rotatably mounted pod disposed within an interior receiving chamber formed in the housing. A spray nozzle is mounted within a chamber formed in the pod. The pod can be rotated so as to allow communication of the nozzle with the interior of the vessel, or so as to allow access for the nozzle when it is not in use.

12 Claims, 3 Drawing Sheets

APPARATUS FOR SPRAYING A LIQUID IN A TANK

The present invention relates to an apparatus for spraying a liquid in a vessel. The chemical, food and beverage processing industries use a variety of process, transportation and storage tanks/vessels which must be periodically cleaned. A common cleaning mechanism used in the prior art comprises a fixed spray nozzle which is placed within the tank. However, in such situations the fixed nozzle is not always capable of cleaning all areas of the vessels effectively. Additionally, in certain tanks, the corrosive nature of the vapors within the tank cause early failure of a device permanently placed therein. One solution to the corrosive environment is the providing of a retraction mechanism for inserting and retracting the spraying device from the tank. While this avoids the corrosive environment within the tank, such devices are difficult to service and maintain, and when necessary, are relatively expensive to repair. Additionally, when toxic or corrosive vapors are present in the vessel there is always the concern that these vapors will escape to the environment. In some pharmaceuticals, food and beverage vessels, spray devices may not be allowed therein during processing. Thus, any spraying nozzle present must be isolated from the contents of the vessel.

Applicants have invented an improved tank cleaning apparatus which is simple in construction and can be used by itself or as an auxiliary device to clean difficult areas or hard to reach areas. The apparatus is constructed so as to allow easy use and access of the spray nozzle and minimize exposure of the spray nozzle to a potentially hazardous environment. Additionally, the apparatus minimizes the potential escape of any potentially harmful vapors from the interior of the vessel to the environment yet provides a stationary fixed cleaning nozzle that can withstand the pressures required.

SUMMARY OF THE INVENTION

An apparatus for directing a liquid spray against the interior walls of a vessel from a nozzle spray means. The apparatus included a housing assembly mounted externally to the vessel. The housing assembly has a discharge opening directed to the interior of the vessel and an access opening directed to the environment outside of the vessel. A receiving chamber is provided between the discharge opening and access opening. A pod is rotatably mounted within the receiving chamber. The pod has an internal chamber having an outlet opening at one section thereof. Means for rotating the pod about a pre-determined axis is provided to allow positioning of the outlet opening of the internal chamber of the pod between the discharge opening and the access opening. A spray means is mounted within the internal chamber of the pod which is capable of being directed towards the discharge opening for spraying a liquid within the vessel when said pod is rotated in a position that allows access thereto. Seals are disposed within said housing assembly for sealing the pod from the interior of the vessel and from the environment.

DETAILED DESCRIPTION OF THE DRAWINGS

DETAILED DESCRIPTION OF THE INVENTION

Figure 1:
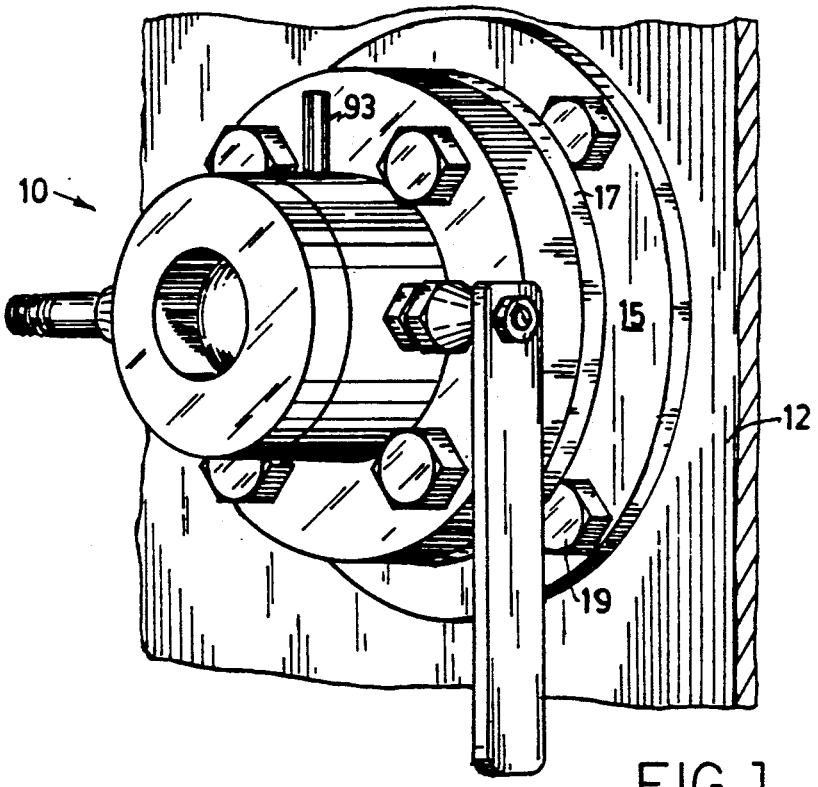
FIG. 1 is a perspective of a cleaning apparatus made in accordance with the present invention as mounted on a tank for which it is to be used.

Referring to FIGS. 1–6 and 8, there is illustrated a cleaning apparatus 10 made in accordance with the present invention designed to be mounted to a storage vessel 12, for example, but not limited to, a vessel for storing and holding chemicals. In the particular embodiment illustrated, cleaning apparatus 10 is secured to a mounting collar 13 which is positioned over an aligned opening 14 in vessel 12. Collar 13 includes an inner flange 15 and outer flange 17. Collar 13 is secured to vessel 12 by bolts 19 that pass through aligned openings in flange 15 and vessel 12, and nuts 11 secured to the threaded end of the bolts. The cleaning 10 apparatus comprises a housing assembly 16 having a body section 18 and a retaining member 22. The body section 18 is secured to outer flange 17 of collar 13 by threaded bolts 19 which pass through an opening in body section 18 into threaded openings in flange 17 and are secured by nuts 11. Body section 18 has a discharge opening 20 which aligns with collar 13 and opening 14 of vessel 12 and is designed to receive a spray cleaning device. Retaining member 22 has an access opening 24. The retaining member 22 is secured to the body section 18 so as to form a central receiving chamber 26 which connects discharge opening 20 with access opening 24. In the particular embodiment illustrated, retaining member 22 has a projecting section 21 having outer threads 23 which engage internal threads 25 in body section 18.

Figure 2:
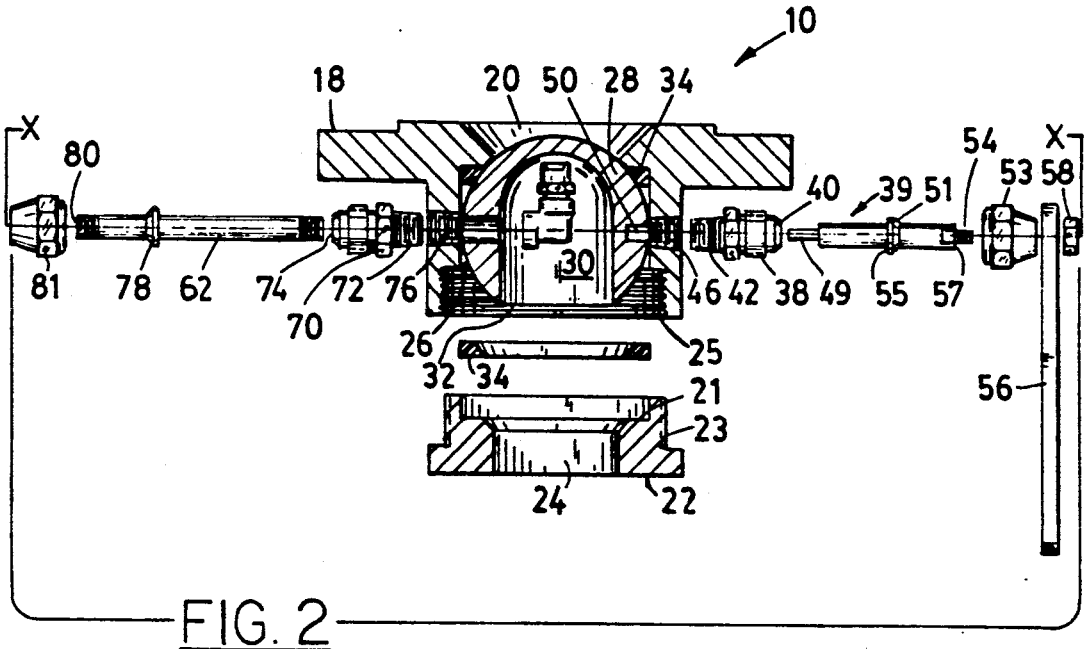
FIG. 2 is an exploded assembly view of the cleaning apparatus of FIG. 1.
Figure 3:
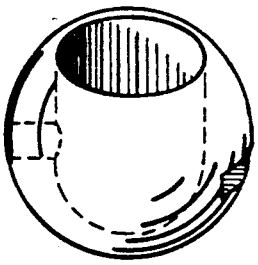
FIG. 3 is a perspective view of the internal rotating pod of the apparatus of FIG. 1.
Figure 4:
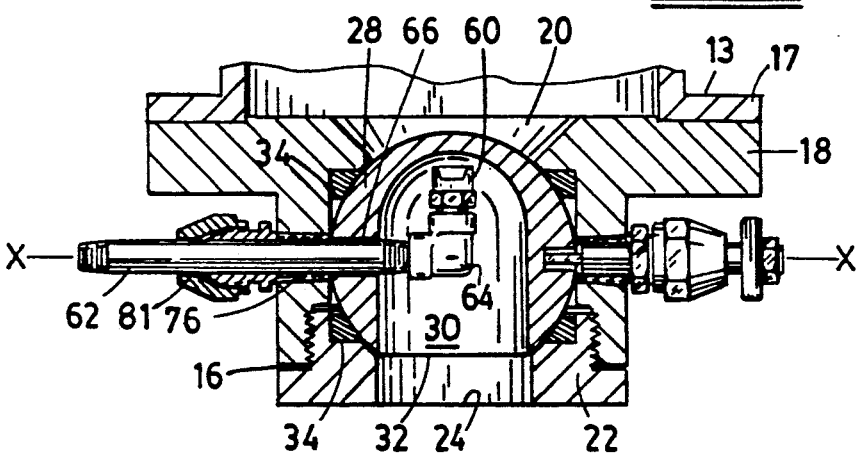
FIG. 4 is a side cross-sectional view of the assembled apparatus of FIG. 1 showing the pod in the closed position.
Figure 5:
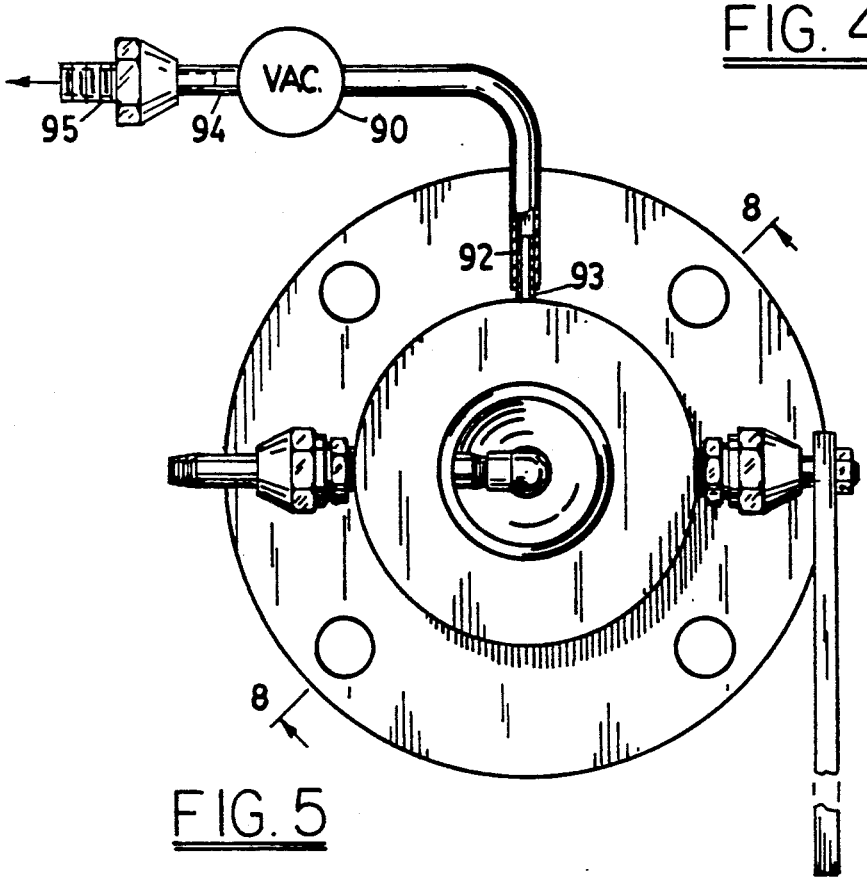
FIG. 5 is an exterior end view of the assembly of FIG. 4.
Figure 6:
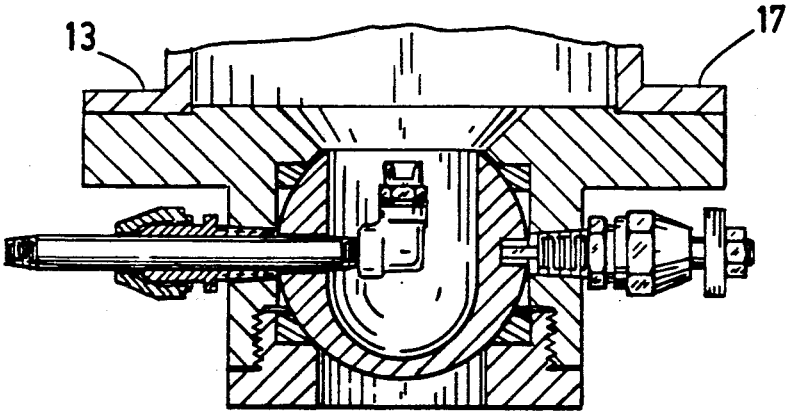
FIG. 6 is a side cross-sectional view similar to FIG. 4 showing the pod in the open position.

Mounted within the central recess chamber 26 is a pod 28 (see FIG. 3) which is rotatably mounted to body section 18 along axis X—X. The pod 28 includes an internal recessed chamber 30, which in the particular embodiment illustrated has a generally U-shape cross-sectional configuration having an open end 32 which opens to the surface of pod 28. The pod 28 is designed such that when rotated about the axis X—X, opening 32 of the pod will align with either the discharge opening 20 or access opening 24. In the preferred embodiment illustrated, pod 28 has a substantially spherical outer configuration which facilitates rotation of the pod 28 within chamber 26. The outer surface of pod 28 in the closed position as illustrated in FIGS. 2 and 4, faces the interior of vessel 12 and resists any pressure that may be applied by the contents thereof. The pod 28 is designed to withstand internal pressures typically found in vessels, for example, up to 300 psi.

Disposed within the housing assembly 16 between body section 18, retaining member 22 and pod 28, there is provided a pair of annular rim seals 34 for sealing the central chamber 26 from the interior of the vessel 12 and from the environment outside the vessel 12. In the embodiment illustrated, the pod 28 is rotatably mounted to the housing assembly 16 through the use of fitting 38 having a central bore 40 and operating shaft 39. The fitting 38 is secured to housing assembly 16 through the use of external threads 42 which engage mating internal threads in opening 46 in body section 18. The operating shaft 39 is sized so that it can rotate freely within bore 40. The operating shaft 39 includes a projection 49 having an outer cross sectional configuration which mates with a correspondingly shaped opening 50 in pod 28. In the particular embodiment illustrated, the projection 49 has a substantially rectangular cross-section configuration such that when operating shaft 39 is rotated it will cause the pod 28 also to rotate about axis X—X. The operating shaft 39 further includes a flared annular projection 51 in its central portion which has an abutment surface 55 which is held in a relative position to the end of fitting 38. A nut 53 engages projection 51 so as to maintain operating shaft 39 in engagement with pod 28. The operating shaft 39 further includes a drive section 54 at its outer end which is designed to receive a handle 56. The drive section 54 preferably includes an inner section 57 having a cross section outer configuration designed to mate with a corresponding shaped opening in handle 56 such that when handle 56 is rotated about axis X—X it will also cause the operating shaft 39 to rotate. In the particular embodiment illustrated, inner section 57 is substantially rectangular in shape. A nut 58 is provided which engages externally thread disposed outer section of device so as to secure the handle to drive section 54.

Mounted within the recess chamber 30 of pod 28 is a fix spray means for providing liquid under pressure to the internal section of the vessel 12. Typically, the spray means must be able to withstand pressures of up to 1000 psi. Generally, pressures in the range of 100 psi to 500 psi are provided to the spray means. In the embodiment illustrated, spray means includes a fluid spray nozzle 60 which is fluidly connected to a fluid inlet pipe 62 through a corner fitting 64 which is fluidly connects nozzle 60 to the inlet pipe 62. Inlet pipe passes through an opening 76 in body section 18 and aligned opening 66 in pod 28. The fluid pipe 62 and openings 76, 66 are aligned with longitudinal axis X—X such that when pod 28 is rotated the fluid inlet pipe 62 will not interfere with the rotation thereof. In the embodiment illustrated, the inlet pipe 62 is secured to body section 18 through the use of a fitting 70 having a male section 72 with external threads which engage internal threads in opening 76 of body section 18. Inlet pipe 62 passes through an internal bore 74 of fitting 70. An annular flange 78 is provided on inlet pipe 62 which mates with a flange (not shown) within fitting 70. A nut 81 passes over the inlet end 80 of inlet pipe 62 so as to capture flange 78 and firmly hold it against the fitting 70. The inlet end 80 of inlet pipe 62 is connected to an appropriate source of fluid to be sprayed within the vessel. As illustrated in FIG. 4, the pod 28 is in the position which closes off the nozzle from the internal portion of the vessel 12. Whereas in FIG. 6 the pod 28 is rotated into a position that allows nozzle 60 to communicate with the internal chamber of vessel 12.

Means are provided to minimize the possibility of the escape of vapor that may be present in apparatus 10 to the environment. In the particular embodiment illustrated, in FIG. 5 a pump 90 is mounted to the exterior of housing assembly 16 by a hose 92 which is fluidly connected to receiving chamber 26 by appropriate fitting 93 and appropriate passageway (not shown) in body section 18. The fluid outlet of pump 90 is connected to a fitting 95 designed for attachment to vessel 12 to allow fluid communication thereto. The pump 90 may be of any desired type capable of removing vapors (or other contaminants) from necessary chamber 26 and returning it to the vessel.

In order to more clearly understand the present invention, applicant will now discuss the operation and use of apparatus 10. Initially, as illustrated in FIG. 4, the pod 28 is positioned such that the internal chamber of vessel 12 is closed from the environment and the cleaning fluid to be supplied to nozzle 60 is in the off position. Once the vessel 12 has been drained or in the ready condition for cleaning, the pod 28 is rotated to the position illustrated in FIG. 6 such that the opening 32 of pod 28 aligns with the discharge opening 20 of body 18. A fluid under the desired pressure is supplied by the appropriate actuation of valves (not shown) such that cleaning fluid will exit nozzle 60. The amount of pressure and time which the vessel 12 is subjected to the cleaning fluid may be varied as desired. The type of solution and time and conditions is of course dependent upon the type of tank and materials to be cleaned, the selection of which is well within one of ordinary skill in the art. After the cleaning cycle has been completed the cleaning solution under pressure is turned off. The pod 28 is then rotated so to close off the central receiving chamber 26 from the interior of vessel 12. Preferably if the pod 38 chamber 26 has been subjected to a potentially harmful vapor, the pod 28 is rotated only 90° to allow any potentially harmful vapors to be drawn off and recycled back into the vessel 12 by pump 90 which can be activated by appropriate controls (not illustrated) as is customarily done in the art. Once any potentially dangerous vapors have been removed, the pod 38 is rotated an additional 90° until it is in the position as illustrated in FIG. 4 wherein the opening 32 coincides with the access opening 24. In this position, the nozzle 60 can be easily cleaned, repaired and/or replaced. Thus it can be seen that the device of the present invention is simple in construction and operation which minimizes exposure of the spray nozzle assembly to the environment of the vessel, and minimizes potential escape of harmful or undesirable vapors. In addition, when the nozzle is not in use there is provided easy and accessible means for cleaning or repairing the nozzle without the need for disassembling of the cleaning housing.

Figure 7:
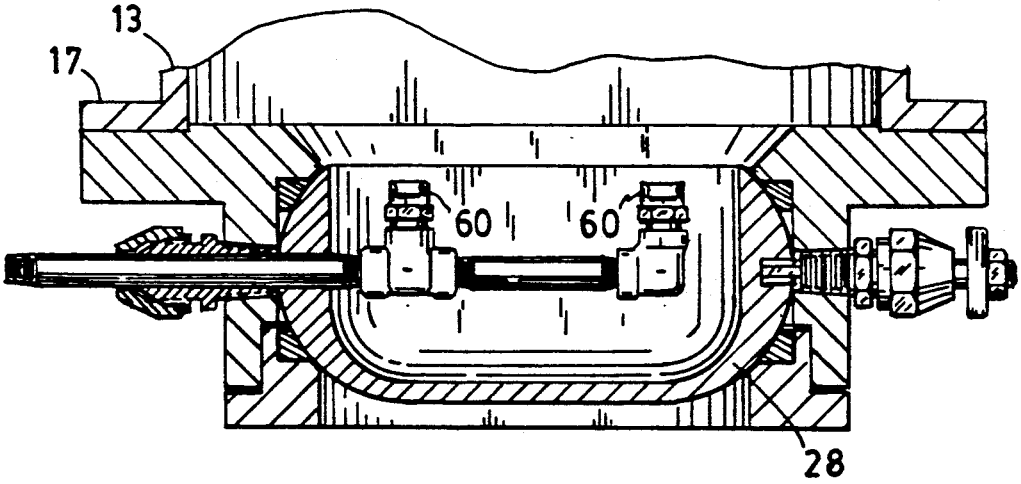
FIG. 7 is a cross-sectional view of a modified cleaning apparatus made in accordance with the present invention as mounted on a tank for which it is to be used.
Figure 8:
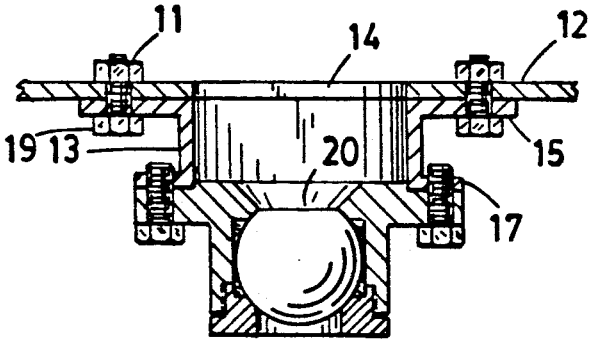
FIG. 8 is a side cross-sectional view of the assembled apparatus of FIG. 1 as mounted on a vessel on which it is to be used showing the pod in the open position.

Referring to FIG. 7, there is illustrated a modified cleaning apparatus made in accordance with the present invention similar to that illustrated in FIGS. 1–6, like numerals indicating like parts. The main distinguishing difference in this embodiment is that instead of having a single nozzle 60 there are provided two nozzles 60. However, as many nozzles desired may be provided. The configuration of the pod 28 has been modified to a generally cylindrical configuration which has been sized so as to accommodate the two cleaning nozzles 60. This embodiment, in all other respects, operates and works in the same manner previously described.

It is to be understood that various changes and modifications may be made without departing from the scope of the present invention. For example, but not by way of limitation, the size and shape of chamber 30 may be selected to any convenient shape and size desired. Further power drive means may be employed to drive operating shaft 39. While the present invention is designed to avoid use of nozzle retraction devices, such can be incorporated within chamber 30 if so desired. Additionally, while a fixed spray nozzle is disclosed, various other spray mechanisms may be used, for example, a fluid driven tank cleaning device sold by Sybron Chemicals, Inc. sold under the Gamajet trademark may be employed. Still further, the cleaning apparatus 10 may be mounted to vessel 12 in any desired manner using standard or non-standard flanges or by direct welding to the vessel.

What is claimed:

1. An apparatus for directing a liquid spray against the interior walls of a vessel comprising:

(a) a housing assembly mounted externally to said vessel, said housing assembly comprising a body portion having a discharge opening in fluid communication with an opening in said vessel and a retaining member secured to said body portion, said retaining member having an access opening directed to the environment outside of said vessel, said body and retaining member forming a central receiving chamber between said discharge opening and access opening;

(b) a pod rotatably mounted within said central receiving chamber of said housing assembly, said pod being capable of being rotated about a pre-determined axis, said pod having an internal chamber having an outlet opening at one section of said pod;

(c) means for rotating said pod about said pre-determined axis so as to allow positioning of said opening of said internal chamber of said pod at any desired position between said discharge opening and said access opening respectively, said means for rotating said pod comprising an operating shaft rotatably mounted to said housing assembly, said operating shaft having an inner end which is secured to said pod so as to cause said pod to rotate when said shaft is rotated, said shaft having a means for causing said shaft to rotate in the desired direction;

(d) spray means mounted within said internal chamber of said pod, said spray means comprising a nozzle which is directed towards said discharge opening for spraying a liquid within said chamber when said pod is rotated in a position that allows access thereto, said nozzle being fluidly connected to an inlet supply pipe mounted to said housing assembly which passes through aligned openings in said pod and said housing assembly; said inlet supply pipe having an inlet end for attachment to a source of appropriate fluid;

(e) a pair of annular seals disposed within said housing assembly in said central receiving chamber for sealing said pod from the interior of said vessel and from said environment.

2. The apparatus according to claim 1 wherein said body portion of said housing assembly is mounted to a collar which is secured to said vessel.

3. An apparatus according to claim 1 wherein said pod has a substantially spherical outer configuration, and said internal pod chamber has a substantially U-shaped cross-sectional configuration.

4. An apparatus according to claim 1 wherein said pod has a substantially cylindrical configuration and said chamber within said pod having a substantially U-shaped configuration.

5. An apparatus according to claim 4 wherein said internal chamber has a plurality of spray means for spraying a liquid within said chamber.

6. An apparatus according to claim 1 wherein said pair of seals are made of teflon or other sealing materials.

7. An apparatus according to claim 1 wherein said apparatus further comprises means for removing vapors from said receiving chamber prior to exposing said outlet of said pod to the environment.

8. An apparatus according to claim 7 wherein said means for removing vapor comprises a pump having an inlet fluidly connected to said receiving chamber and an outlet fluidly connected to the interior of said vessel.

9. An apparatus for directing a liquid spray against the interior walls of a vessel comprising:

(a) a housing assembly mounted externally to said vessel, said housing assembly having a discharge opening for communication with the interior of said vessel and an access opening directed to the environment outside of said vessel, and a receiving chamber between said discharge opening and access opening;

(b) a pod rotatably mounted within said receiving chamber of said housing assembly, said pod being capable of being rotated about a pre-determined axis, said pod having an internal chamber having an outlet opening at one section of said pod;

(c) means for rotating said pod about said pre-determined axis so as to allow positioning of said opening of said internal chamber of said pod at any desired position between said discharge opening and said access opening respectively;

(d) spray means mounted within said internal chamber of said pod, said spray means capable of being directed towards said discharge opening for spraying a liquid within said chamber when said pod is rotated in a position that allows access to said chamber.

10. An apparatus according to claim 9 further comprising seals means disposed within said housing assembly in said central receiving chamber for sealing said pod from the interior of said vessel and from said environment.

11. An apparatus according to claim 9 wherein said apparatus further comprises means for removing vapors from said receiving chamber prior to exposing said outlet of said pod to the environment.

12. An apparatus according to claim 11 wherein said means for removing vapor comprises a pump having an inlet fluidly connected to said receiving chamber and an outlet fluidly connected to the interior of said vessel.

* * * * *